US005687632A

United States Patent [19]

Sugawa

[11] Patent Number: 5,687,632

[45] Date of Patent: Nov. 18, 1997

[54] HYDRAULIC RODLESS CYLINDER TYPE ACTUATOR

[76] Inventor: Hiroshi Sugawa, 844-2, Iizawa, Kurobe-shi, Toyama-ken, Japan

[21] Appl. No.: 552,054

[22] Filed: Nov. 2, 1995

[30] Foreign Application Priority Data

Nov. 2, 1994 [JP] Japan ..... 6-293956

[51] Int. Cl.[6] ..... F01B 29/00; F01B 9/00

[52] U.S. Cl. ..... 92/88; 92/137

[58] Field of Search ..... 92/88, 137

[56] References Cited

FOREIGN PATENT DOCUMENTS

| | | | |
|---|---|---|---|
| 2800318 | 7/1979 | Germany | 92/137 |
| 484309 | 12/1975 | U.S.S.R. | 92/137 |
| 932201 | 7/1963 | United Kingdom | 92/137 |
| 2051957 | 1/1981 | United Kingdom | 92/137 |
| 2233711 | 1/1991 | United Kingdom | 92/137 |

*Primary Examiner*—Hoang Nguyen
*Attorney, Agent, or Firm*—Sughrue,Mion,Zinn,Macpeak & Seas, PLLC

[57] ABSTRACT

In a hydraulic rodless cylinder type actuator, a piston is movable back and forth in a hydraulic cylinder. Housing elements are respectively mounted on the opposite ends of the cylinder. Parallel output shafts are respectively accommodated in the housing elements and protrude therefrom in a fluid-tight condition. The linear movement of the piston is translated into the rotation of the output shafts by flexible inner power transmission elements. Flexible outer power transmission elements are provided on the protruding ends of the output shafts in order to deliver a high output from a high-pressure chamber defined in the cylinder to the outside of the cylinder.

3 Claims, 4 Drawing Sheets

HYDRAULIC RODLESS CYLINDER TYPE ACTUATOR

BACKGROUND OF THE INVENTION

The present invention relates to a new type of actuator capable of implementing a high-output rodless cylinder.

I have proposed an actuator having the above capability, as disclosed in U.S. Pat. No. 4,312,432, European Patent No. 0016840, and Japanese Patent Publication No. 62-364. The actuator has a hydraulic cylinder accommodating a piston therein. Housing elements are respectively mounted on opposite ends of the cylinder. Parallel output shafts are respectively provided in the housing elements in a fluid-tight condition, and each protrudes to the outside of the associated housing element. Flexible inner power transmission elements translate the linear movement of the piston into the rotation of the output shafts. Flexible outer power transmission elements are passed over the protruding portions of the output shafts and deliver high output power from a high pressure chamber defined in the cylinder to the outside of the cylinder. In this kind of actuator, a high hydraulic pressure introduced into the high pressure chamber can be sealed relatively easily by seal members conventionally used with a rotary shaft. The maximum output available with the actuator depends on the flexible power transmission elements passed over the protruding portions of the output shafts, e.g., wire ropes, belts, silent chains, link chains, or roller chains.

A recent achievement in the power transmission art is a high-power roller chain for heavy load applications and having large diameter pins and large diameter rollers. Although the tips of sprockets may be sharp and thin, the sprockets receive loads with their roots and can accommodate heavy loads. The present invention uses such a high-power roller chain to implement outputs of as great as 8 tons. The maximum load applicable to the high-power roller chain is about four times as great as the maximum load available with an ordinary chain or about three times as great as the maximum load available with a reinforced chain.

SUMMARY OF THE INVENTION

It is an object of the present invention to provide an improved new type of actuator capable of implementing a high-output hydraulic rodless cylinder.

A hydraulic rodless cylinder type actuator of the present invention has hydraulic cylinder, a piston fluid-tightly received in the cylinder and movable along the axis of the cylinder, and housing elements respectively mounted on the opposite ends of the cylinder. A pair of output shafts are respectively accommodated in the housing elements, protrude from the housing elements in a fluid-tight condition, and extend perpendicularly to and are spaced from the axis of the cylinder. A pair of inner sprockets are respectively affixed to the output shafts within the housing elements. A pair of outer sprockets are respectively affixed to the output shafts. Inner chains are each anchored to the piston at one end and left free at the other end while having the intermediate portion thereof passed over one of the inner sprockets, and has a length great enough to extend in parallel to the cylinder. Chain cases are respectively fluid-tightly communicated to the housing elements, and respectively guide the inner chains between a position where they leave the respective inner sprockets and a position where they extend in parallel to the cylinder. An outer chain is passed over the outer sprockets outside of the housing elements.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
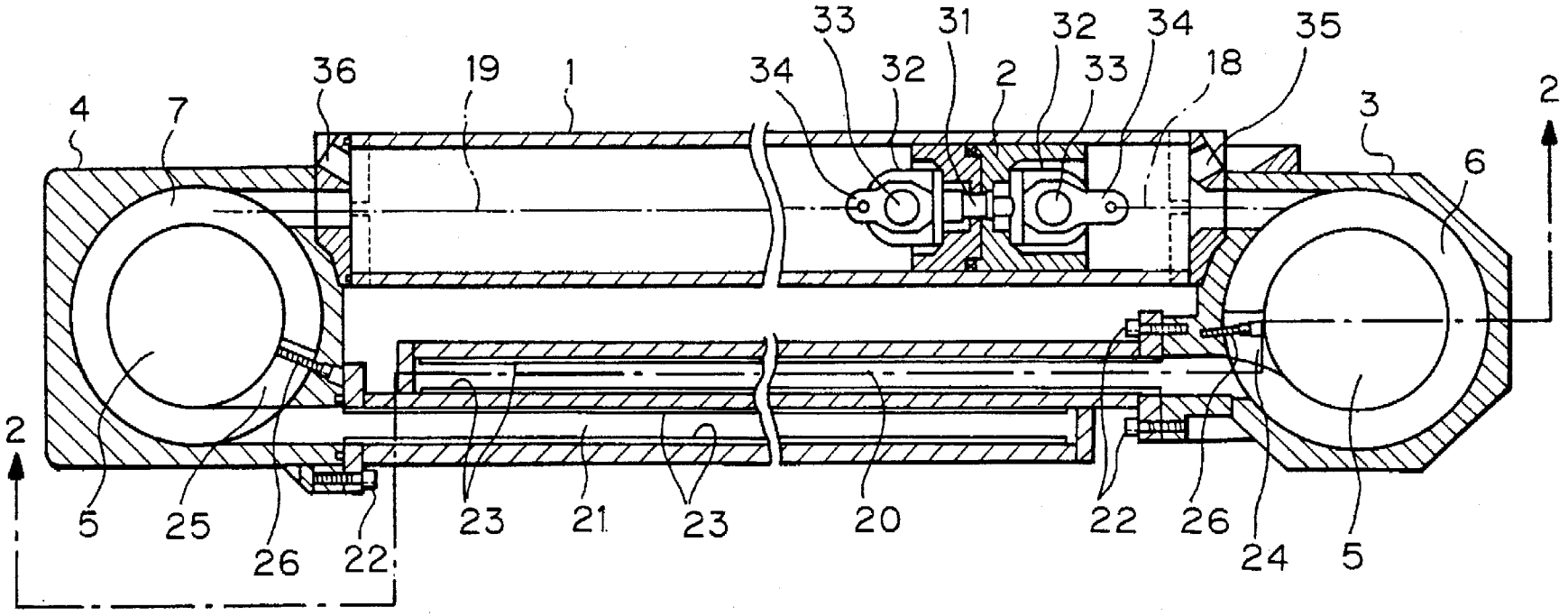
FIG. 1 is a front view showing, partly in a vertical section, a hydraulic rodless cylinder type actuator embodying the present invention.
Figure 2:
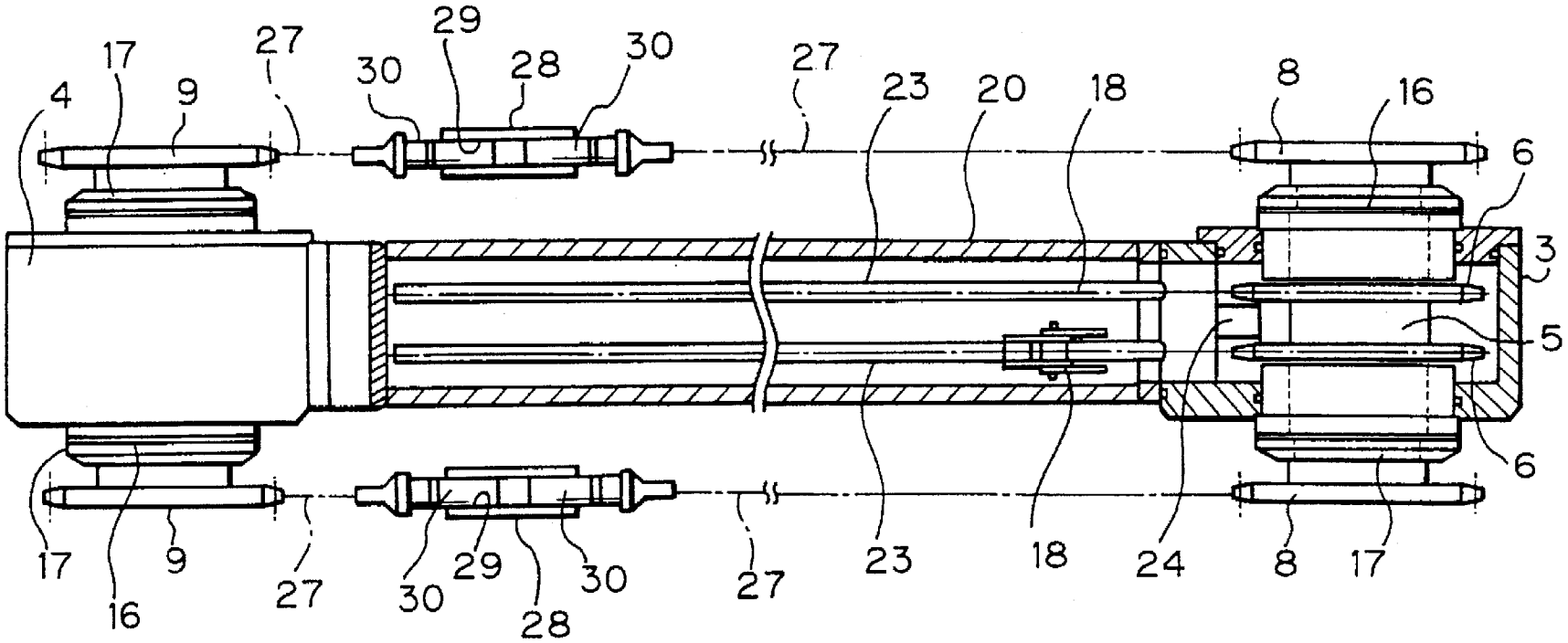
FIG. 2 is a plan view showing, partly in a horizontal section, the embodiment shown in FIG. 1.
Figure 3:
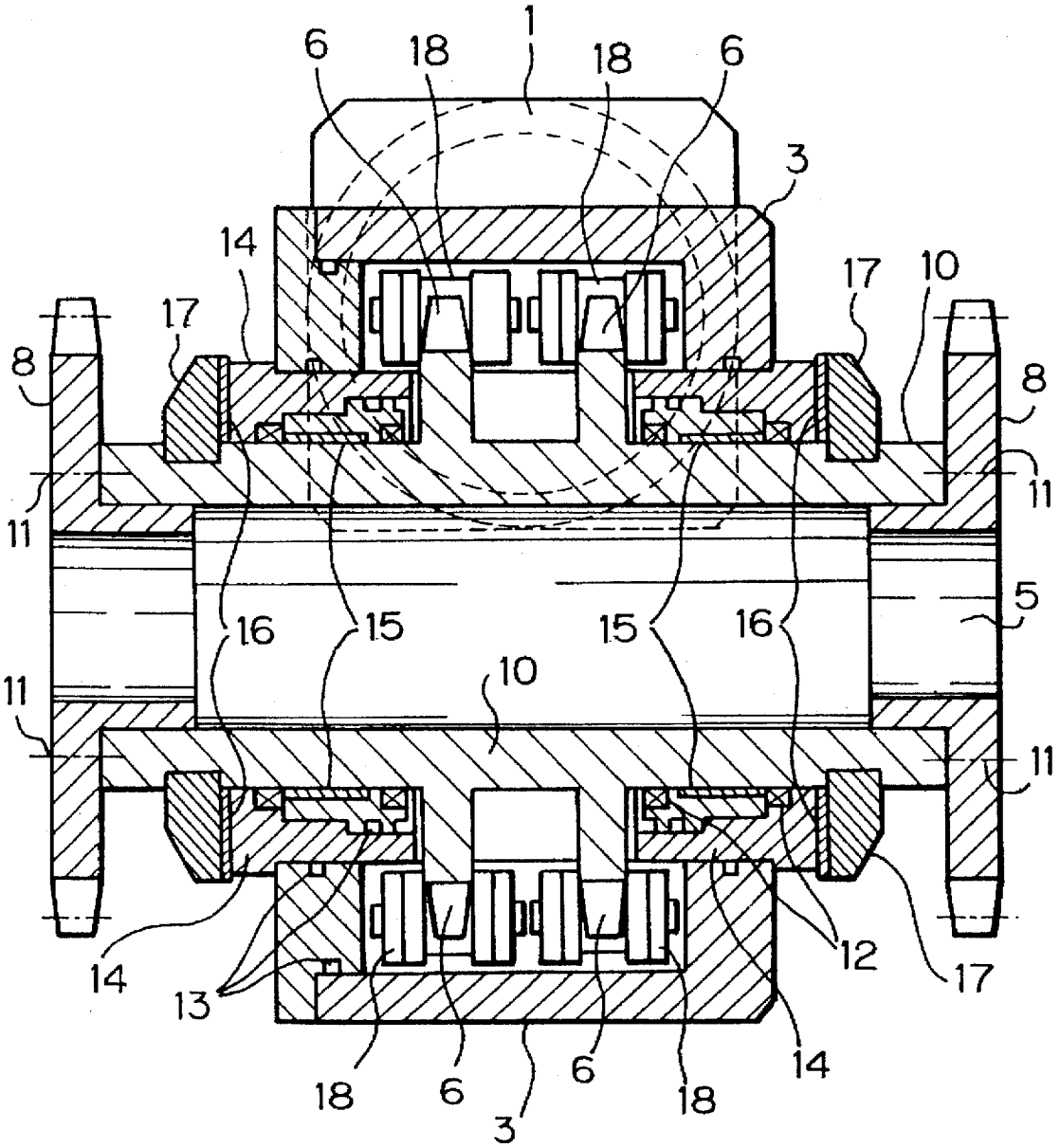
FIG. 3 is a side elevation showing, partly in a vertical section, an essential part of the embodiment shown in FIG. 1.
Figure 4:
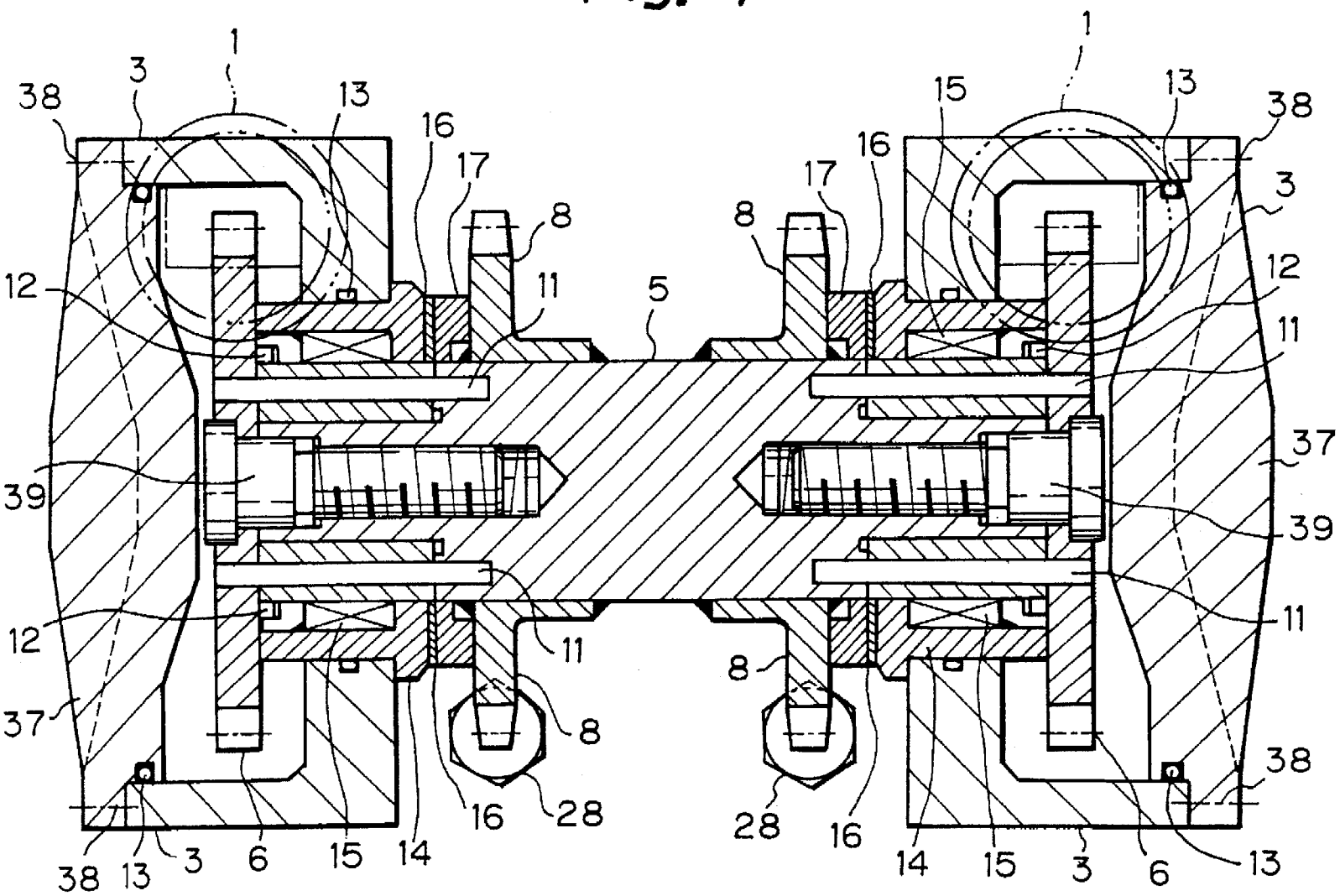
FIG. 4 is a side elevation showing, partly in a vertical section, an alternative embodiment of the present invention.

FIGS. 1–3 show a preferred embodiment of the actuator in accordance with the present invention while FIG. 4 shows an alternative embodiment of the present invention.

In both of the embodiments, a piston 2 is accommodated in the cylinder 1 in a fluid-tight condition and movable back and forth along the axis of the cylinder 1. Housing elements 3 and 4 are respectively mounted on the axially opposite ends of the cylinder 1. A pair of parallel output shafts 5 are respectively accommodated in the housing elements 3 and 4, and each extends out from the housing 3 or 4 in a fluid-tight condition. The output shafts 5 extend perpendicularly to and are spaced from the axis of the cylinder. A pair of inner sprockets 6 and a pair of inner sprockets 7 are respectively affixed to the output shafts 5 within the housing elements 3 and 4. A pair of outer sprockets 8 and a pair of outer sprockets 9 are respectively affixed to the output shafts 5 outside of the housing elements 3 and 4.

Specifically, in the embodiment shown in FIGS. 1–3, the outer sprockets 8 and 9 are respectively mounted on the opposite ends of the output shafts 5. The pair of inner sprockets 6 and the pair of inner sprockets 7 are respectively mounted on the intermediate portions of the output shafts 5 in order to balance the output in relation to the outer sprocket pairs 8 and 9.

FIG. 3 shows only the constituent parts of the actuator arranged at the right-hand side of the cylinder 1 as viewed in FIG. 1. As shown, the inner sprockets 6 are formed integrally with the intermediate portion of a sleeve 10 which is mounted on the output shaft 5. The outer sprockets 8 are affixed to the sleeve 10 by several connecting pins 11, so that the former is rotatable integrally with the latter. Bearing support members 14 each has seal members 12 and O-rings 13 and intervenes between the housing element 3 and the sleeve 10. The support members 14 support the sleeve 10 via axial bearings 15 and thrust bearings 16 such that the sleeve 10 is rotatable relative to the housing element 3. Pressure receiving members 17 are affixed to the outer periphery of the sleeve 10, and each faces the adjoining bearing support member 14 with the intermediary of the thrust bearing 16.

A pair of inner chains 18 are implemented by high-power roller chains and anchored to one end of the piston 2 at one end thereof. Each inner chain 18 is passed over one of the inner sprockets 6 at the intermediate portion thereof while having the other end thereof left free. Likewise, a pair of inner chains 19 are implemented by high-power roller chains and anchored to the other end of the piston 2 at one end thereof. Each inner chain 19 is passed over one of the inner sprockets 7 at the intermediate portion thereof while having the other end thereof left free. The inner chains 18 and 19 each has a length great enough to extend in parallel to the cylinder 1.

Chain cases 20 and 21 are respectively fastened to the housing elements 3 and 4 by screws 22 and fluid-tightly communicated thereto. The chain cases 20 and 21 each extends from the position where the inner chains 18 or 19 leave the associated inner sprockets 6 or 7 to the position where the chains 18 or 19 extend parallel to the cylinder 1. The free ends of the chains 18 and 19 are respectively received in and guided by the cases 20 and 21. The cases 20 and 21 each has chain roller guides 23 extending on the top and the bottom of the inner periphery thereof. Chain removers 24 and 25 are respectively fastened to the housing elements 3 and 4 by screws 26 at the inlets of the cases 20 and 21. The chain removers 24 and 25 each contacts the associated roller chains 18 or 19 at a position where the chains 18 or 19 leave the inner sprockets 6 or 7.

Outer chains 27, also implemented by high-output roller chains, are positioned outside of the the housings 3 and 4, and each is passed over the outer sprockets 8 and 9 aligned with each other in the axial direction of the cylinder 1. A tension adjusting and heavy load bearing portion 28 is included in the part of each outer chain 27 located at the opposite side to the cylinder 1 with respect to a plane containing the axes of the two output shafts 5. The portion of each outer chain 27 located at the same side as the cylinder 1 with respect to the above plane is split and connected together by a tension spring, although not shown in the figures. In the illustrative embodiment, the tension adjusting and heavy load bearing portion 28 is implemented as a tensioner having of a tube 29 formed with opposite female screw threads in the inner periphery thereof, and male screw members 30 respectively connected to the ends of the associated outer chain 27 and respectively threaded into the opposite ends of the tube 29. A connecting shaft 31 is received in and extends along the axis of the cylinder 1 in a fluid-tight condition. The shaft 31 connects bearing plates 32 to each other. A pivot shaft 33 is mounted on each bearing plate 32 perpendicularly to the shaft 31. The inner chains 18 and 19 are respectively anchored to the bearing plates 32.

In operation, assume that a high hydraulic pressure is introduced into the cylinder 1 via a port 35 formed in the right end of the cylinder 1 as viewed in FIG. 1. The pressure causes the piston 2 to move to the left while discharging a hydraulic fluid via a port 36 formed in the left end of the cylinder 1. At this instant, the piston 2 pulls the inner chains and thereby causes the right inner sprockets 6 to rotate counterclockwise. As a result, the free ends of the inner chains 18 are sequentially pulled out of the chain case 20. The inner sprockets 6, in turn, cause the outer sprockets 8 coaxial therewith to rotate counterclockwise. Consequently, the outer chains 27 and, therefore, the heavy load bearing portions 28 affixed to the lower runs of the chains 27 are thrusted to the right. At this instant, the runs of the outer chains 27 located at the same side as the cylinder 1 with respect to the previously mentioned plane move linearly without slackening due to the tension springs connecting their split ends. As a result, the outer sprockets 9 and, therefore, the inner sprockets 7 are rotated by the chains 27. The inner sprockets 7 cause the outer chains 27 passed thereover to move counterclockwise while having their free ends sequentially guided into the chain case 21. The above procedure also occurs when the piston 2 is moved to the right in the cylinder 1, although the directions in which the constituents at the right and the left of the piston 2 move are reversed.

FIG. 4 is a view similar to FIG. 3 and shows an alternative embodiment of the present invention. In FIG. 3, the same or similar constituents as the constituents shown in FIG. 4 are designated by the same reference numerals, and a detailed description thereof will not be made in order to avoid redundancy. As shown, the actuator has a pair of hydraulic cylinders 1 each accommodating the respective piston 2, not shown. The inner sprockets 6 are mounted on opposite ends of the associated output shaft 5 and respectively operated by the two cylinders 1. The outer sprockets 8 are mounted on the intermediate portion of the output shaft 5. A linearly movable load member is mounted on each tensioner or similar heavy load bearing portion 28 by a suitable mounting mechanism. In this configuration, high output derived from a high hydraulic pressure applied to each piston can be transferred to the load members at the intermediate portion of the output shaft 5 without being obstructed by the housing element 3. In addition, this embodiment is practicable with simple constituent parts and simple seal arrangements.

In the alternative embodiment, the housing elements 3 each supports the output shaft 5 via the bearing support member 14, axial bearing 15, and thrust bearing 16. A cover 37 is affixed to each of the housing elements 3 by screws 38 and implemented by a casting. The inner sprockets 6 are each affixed to the output shaft 5 by screws 39 at the center of the shaft 5. Further, each sprocket 6 is affixed to the shaft 5 by about twelve pins 11 around the screw 39. The outer sprockets 8 are soldered to the output shaft 5.

I conducted a series of load tests with the actuator of the present invention. For the tests, the actuator was provided with a cylinder having an inside diameter of 100 mm and a length of 1,450 mm. The actuator had an overall length of 1,920 mm and a stroke of 1,300 mm. Output shafts had their axes spaced 1,690 mm from each other, and each had a diameter of 100 mm. Further, the actuator was provided with seal members VARISEAL (trade name) available from Shamban & Captain, Inc., roller chains ENUMA 845U (trade name) available from Enuma Chain MFG Co., Ltd., and sprockets each having twenty-one teeth. Use was made of a vertical load testing machine available from Nachi Fujikoshi Corporation and having a load cylinder having an inside diameter of 225 mm, a rod having a diameter of 140 mm, and a stroke of 1,200 mm. First, the weight of the piston rod of the load side was pushed up and was found to start moving when the hydraulic pressure was 1.8 MPa. Smooth operation was achieved at a speed as low as about 4 mm per second. Subsequently, the hydraulic pressure acting in the load cylinder was raised in order to measure the pressure at which the rodless cylinder starts raising the load cylinder. The rodless cylinder operated smoothly even at pressures of 3.5 MPa and 7.0 MPa. Thereafter, the load pressure and delivery pressure were increased in a peak pressure measurement fashion because the nominal pump delivery pressure is limited. As a result, 9 MPa, 10 MPa and peak pressure were measured for several seconds each. Even a load test whose maximum pressure was 10 MPa showed that the rodless cylinder was free from leakage and other troubles and operated smoothly at low speeds.

In summary, it will be seen that the present invention provides a hydraulic rodless cylinder type actuator having the following unprecedented advantages.

(1) Inner chains passed over respective inner sprockets are not endless. When a high hydraulic pressure is introduced into a hydraulic cylinder, the resulting power acts on a piston and causes it to move while pulling the inner chains anchored to one end thereof. The power is transferred to one of parallel output shafts and outer sprockets mounted thereon via the inner sprockets over which the above inner chains are passed. As a result, the power is transformed to the tensile forces of outer chains passed over the outer sprockets. Hence, if a linearly movable load member is mounted on the outer chains, a high output derived from the high hydraulic pressure acting on the piston can be transmitted to the load member. In addition, because the inner chains are not endless, their free ends can be easily received in a chain case fluid-tightly communicated to a hydraulic cylinder, or high-pressure chamber, and a housing element.

(2) Tension is applied to the portions of the outer chains located at the opposite side to the hydraulic cylinder. The tension is adjustable to remove the slack of the inner chains via the outer sprockets, output shafts and inner sprockets, and to remove the slack (elasticity) between the inner chains and the outer chains. In this condition, the inner chains and the outer chains respectively serve as inner power transmission elements and outer power transmission elements which are passed over the output shafts in an endless configuration and are flexible, but not elastic.

Various modifications will become possible for those skilled in the art after receiving the teachings of the present disclosure without departing from the scope thereof. For example, while in the embodiments the inner chains 18 and 19, outer chains 27, inner sprockets 6 and 7, and outer sprockets 8 and 9 are each provided in two pairs, they may, of course, be provided in a single pair or in three or more pairs each.

What is claimed is:

1. A hydraulic rodless cylinder type actuator comprising:

a hydraulic cylinder;

a piston fluid-tightly received in said cylinder and movable along an axis of said cylinder;

housing elements respectively mounted on opposite ends of said cylinder;

a first output shaft and a second output shaft respectively accommodated in said housing elements, and protruding from said housing elements in a fluid-tight condition, and extending perpendicularly to and spaced from an axis of said cylinder;

a first inner sprocket and a second inner sprocket respectively affixed to said first and second output shafts within the respective housing elements;

a first outer sprocket and a second outer sprocket respectively affixed to said first and second output shafts;

a first inner chain and a second inner chain respectively anchored at one end to opposite sides of said piston, with each of said first and second inner chains being left free at the other end so as to form a free end portion, while having an intermediate portion thereof passed over a corresponding one of said first and second inner sprockets, and having a length great enough to extend in parallel to said cylinder;

chain cases respectively fluid-tightly communicated to said housing elements, and for respectively receiving and guiding said free end portions of said first and second inner chains between a position where said free end portions of said first and second inner chains leave the respective first and second inner sprockets and a position where said free end portions of said first and second inner chains extend in parallel to said cylinder; and an outer chain passed over said first and second outer sprockets outside of said housing elements.

2. An actuator as claimed in claim 1, further comprising a tension adjusting and heavy load bearing portion included in a part of said outer chain located at a side opposite to said cylinder with respect to a plane containing axes of said first and second output shafts, wherein a part of said outer chain located at a same side as said cylinder with respect to said plane is split and connected together by a tension spring member.

3. An actuator as claimed in claim 1, wherein said piston, fluid-tightly received in said cylinder, includes a piston seal and defines two operating chambers which include said chain cases for accommodating said free end portions of said first and second inner chains and which are sealed from each other by said piston seal.

* * * * *